US007379029B2

(12) United States Patent
Rolnik

(10) Patent No.: US 7,379,029 B2
(45) Date of Patent: May 27, 2008

(54) WAVEGUIDE SLOT ANTENNA AND ARRAYS FORMED THEREOF

(75) Inventor: Mordechai Rolnik, Ashdod (IL)

(73) Assignee: Elta Systems Ltd, Ashdod (IL)

( * ) Notice: Subject to any disclaimer, the term of this patent is extended or adjusted under 35 U.S.C. 154(b) by 227 days.

(21) Appl. No.: 11/235,534

(22) Filed: Sep. 27, 2005

(65) Prior Publication Data

US 2007/0069966 A1 Mar. 29, 2007

(51) Int. Cl.
*H01Q 13/10* (2006.01)

(52) U.S. Cl. ..... 343/770; 343/771

(58) Field of Classification Search ..... 343/767, 343/768, 770, 771

See application file for complete search history.

(56) References Cited

U.S. PATENT DOCUMENTS

| | | | | |
|---|---|---|---|---|
| 2,628,311 | A * | 2/1953 | Lindenblad | 343/771 |
| 3,523,297 | A | 8/1970 | Fee | |
| 3,740,751 | A | 6/1973 | Nemit | |
| 5,019,831 | A * | 5/1991 | Yee et al. | 343/771 |
| 5,049,895 | A * | 9/1991 | Ito et al. | 343/785 |
| 5,194,876 | A | 3/1993 | Schnetzer et al. | |
| 5,369,414 | A * | 11/1994 | Yee et al. | 343/771 |
| 5,473,334 | A * | 12/1995 | Yee et al. | 343/756 |
| 5,541,612 | A | 7/1996 | Josefsson | |
| 5,579,019 | A | 11/1996 | Uematsu et al. | |
| 5,638,079 | A | 6/1997 | Kastner et al. | |
| 5,831,583 | A | 11/1998 | Lagerstedt et al. | |
| 6,351,244 | B1 * | 2/2002 | Snygg et al. | 343/770 |
| 6,429,825 | B1 | 8/2002 | Martek | |
| 6,731,241 | B2 | 5/2004 | Park et al. | |
| 2004/0056814 | A1 | 3/2004 | Park et al. | |
| 2005/0140556 | A1 * | 6/2005 | Ohno et al. | 343/770 |

FOREIGN PATENT DOCUMENTS

| | | |
|---|---|---|
| FR | 2 733 357 | 10/1996 |

* cited by examiner

*Primary Examiner*—Hoanganh Le
(74) *Attorney, Agent, or Firm*—Browdy and Neimark

(57) ABSTRACT

A waveguide slot antenna element, waveguide slot antenna arrays comprising a plurality of the waveguide slot antenna elements and a method of operating the waveguide slot antenna arrays are described. The waveguide slot antenna element includes a non-radiating side including a feeding port, a radiating side disposed opposite to the non-radiating side and including at least one pair of radiating slots, and an energy splitter arrangement accommodated between the radiating and non-radiating sides along a path of an ingress electromagnetic field propagating from the feeding port towards said at least one pair of radiating slots. The method of operating the waveguide slot antenna arrays includes supplying electromagnetic energy of a predetermined frequency to the feeding ports of a first pair of slot antenna linear arrays and a second pair of slot antenna linear arrays independently of each other, thereby to generate an electromagnetic field of desired polarization.

18 Claims, 5 Drawing Sheets

WAVEGUIDE SLOT ANTENNA AND ARRAYS FORMED THEREOF

FIELD OF THE INVENTION

The present invention relates generally to waveguide antenna arrays, and in particular, to waveguide slot antenna arrays.

BACKGROUND OF THE INVENTION

Slotted waveguide antennas are well known and utilized in the art for emitting microwave electromagnetic field of desired polarization, e.g., vertical, horizontal or circular.

For example, U.S. Pat. No. 3,740,751 to Nemit describes a slotted-waveguide array having a dual-slot configuration. The pattern of the array sub-group has a null in the direction at which a grating lobe would occur in an antenna having single slot-element per radiator.

U.S. Pat. No. 3,523,297 to Fee describes a dual frequency antenna array that is composed of slotted hollow fin trough waveguide with obstacles located on the sides of the hollow center fin. The trough guide with obstacles located on the sides of the hollow center fin is the low frequency section of the antenna. The slotted hollow center fin, on the other hand, constitutes the high frequency section of the antenna.

U.S. Pat. No. 5,541,612 to Josefsson describes a waveguide antenna that includes a pair of waveguides having two super-imposed single-mode hollow waveguides which are mutually separated by a partition wall. Electromagnetic waves having two mutually perpendicular polarizations are emitted through separate antenna ports, which are comprised of two separate arrays of slots in the upper wall of the upper waveguide. Selected polarization of one transmitted electromagnetic field can be obtained by varying the amplitude and phase of the signals to respective antenna ports.

U.S. Pat. No. 5,638,079 to Kastner et al describes a slotted waveguide array antenna comprising a plurality of waveguide elements extending in a parallel side-by-side relation. A radiating side is formed with a plurality of slots. The slots are slanted to the longitudinal axis of the antenna in alternating directions and are spaced apart such as to offset phase reversal between each pair of adjacent slots. The slotted waveguide array antenna also includes an asymmetric ridge formed on a non-radiating side opposite to the radiating side.

U.S. Pat. No. 5,831,583 to Lagerstedt et al describes a waveguide antenna that includes a number of longitudinal waveguides with lateral and longitudinal slots arranged to emit electromagnetic fields with separate directions of polarization. The waveguide antenna includes a first waveguide having a first rectangular cross-section with lateral slots at substantially right angles with respect to the longitudinal axis of the first waveguide. The lateral slots are arranged in a first short side of the first waveguide. The waveguide antenna also includes a second waveguide having a second rectangular cross-section with longitudinal slots arranged in a second short side at substantially right angles with respect to the lateral slots, and a separating wall. The first and second waveguides are joined at respective first and second broad sides with the first and second short sides facing the same direction.

U.S. Pat. No. 6,731,241 to Park et al describes a dual-polarization common aperture antenna that includes firs and second arrays of radiating slots disposed in a faceplate. The second array is orthogonal and therefore cross-polarized relative to the first array. The first array and the second array share a common aperture.

SUMMARY OF THE INVENTION

According to one aspect of the present invention, there is provided a waveguide slot antenna element having a non-radiating side and a radiating side disposed opposite to the non-radiating side. The non-radiating side includes a feeding port, while the radiating side includes a at least one pair of radiating slots. The waveguide slot antenna element includes an energy splitter arrangement accommodated between the radiating and non-radiating sides along a path of an ingress electromagnetic field propagating from the feeding port towards the radiating slots. The energy splitter arrangement is configured as a one-stage or multi-stage energy splitter to direct the ingress electromagnetic field from the feeding port to the corresponding pairs of radiating slots.

According to an embodiment of the invention, the radiating slots are spaced apart at a predetermined distance from each other. For example, the predetermined distance can be in the range of 0.5 $\lambda$ to 0.9$\lambda$, and preferably about 0.7 $\lambda$ where $\lambda$ is the desired operating wavelength of the antenna.

According to an embodiment of the invention, the radiating slots are parallel to each other and slanted to a longitudinal axis of the slot antenna element in the same direction. For example, the slots can be inclined at an angle in the range of 30° to 60°, and preferably at an angle of about 45° respect to the longitudinal axis.

According to an embodiment of the invention, the width of the waveguide slot antenna element is less or equal to 0.4$\lambda$.

According to the invention, the slot antenna element is configured to operate within any microwave frequency range.

According to another aspect of the present invention, there is provided a waveguide slot antenna linear array comprising a plurality of the slot antenna elements described above, which element being arranged along a longitudinal axis of the slot antenna linear array in a side-by-side relation.

According to still another aspect of the present invention, there is provided a waveguide slot antenna planar array comprising a plurality of the waveguide slot antenna linear arrays arranged along a longitudinal axis of the antenna array and stacked in a parallel relation.

According to an embodiment of the invention, the plurality of the waveguide slot antenna linear arrays includes a first pair of slot antenna linear arrays and a second pair of slot antenna linear arrays arranged in a parallel relation. The radiating slots of the first pair of slot antenna linear arrays are interleaved with the slots of the second pair of slot antenna linear arrays so that the slots of the first pair and the slots of the second pair are slant to the longitudinal axis in the counter directions. For example, radiating slots of the first pair can be slanted at about 45 degrees with respect to the longitudinal axis of the antenna array, and be at right angles with respect to the radiating slots of the second pair.

According to one embodiment of the invention, the radiating slots in each pair of antenna arrays are level with each other.

According to another embodiment of the invention, the radiating slots of the first pair of slot antenna linear arrays can be shifted along the longitudinal axis at a certain distance with respect to the radiating slots of the second pair of slot antenna linear arrays.

According to yet another aspect of the present invention, there is provided a method of operating the waveguide slot antenna planar array described above. The method includes the step of supplying electromagnetic energy of a predetermined frequency to the feeding ports of the first pair of slot antenna linear arrays and the second pair of slot antenna linear arrays independently of each other; thereby to generate an electromagnetic field of desired polarization.

According to one embodiment of the present invention, the supplying of electromagnetic energy includes energizing the first pair of slot antenna linear arrays in phase with the second pair of slot antenna linear arrays, thereby to generate an electromagnetic field having the polarization of the radiated electromagnetic field linear and perpendicular to the longitudinal axis of the waveguide slot antenna planar array.

According to another embodiment of the present invention, the supplying of electromagnetic energy includes energizing the first pair of slot antenna linear arrays in out of phase with the second pair of slot antenna linear arrays, thereby to generate an electromagnetic field having orthogonal linear polarization of the radiated electromagnetic field.

According to still another embodiment of the present invention, the supplying of electromagnetic energy includes energizing the first pair of slot antenna linear arrays and the second pair of slot antenna linear arrays in phase quadrature, thereby to generate an electromagnetic field having circular polarization.

The slot antenna arrays of the present invention has many of the advantages of the prior art techniques, while simultaneously overcoming some of the disadvantages normally associated therewith.

The slot antenna arrays according to the present invention may be easily and efficiently manufactured.

The slot antenna arrays according to the present invention are of durable and reliable construction.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF SPECIFIC EMBODIMENTS

The principles and operation of a slot antenna array according to the present invention may be better understood with reference to the drawings and the accompanying description. It being understood that these drawings are given for illustrative purposes only and are not meant to be limiting.

Figure 1:
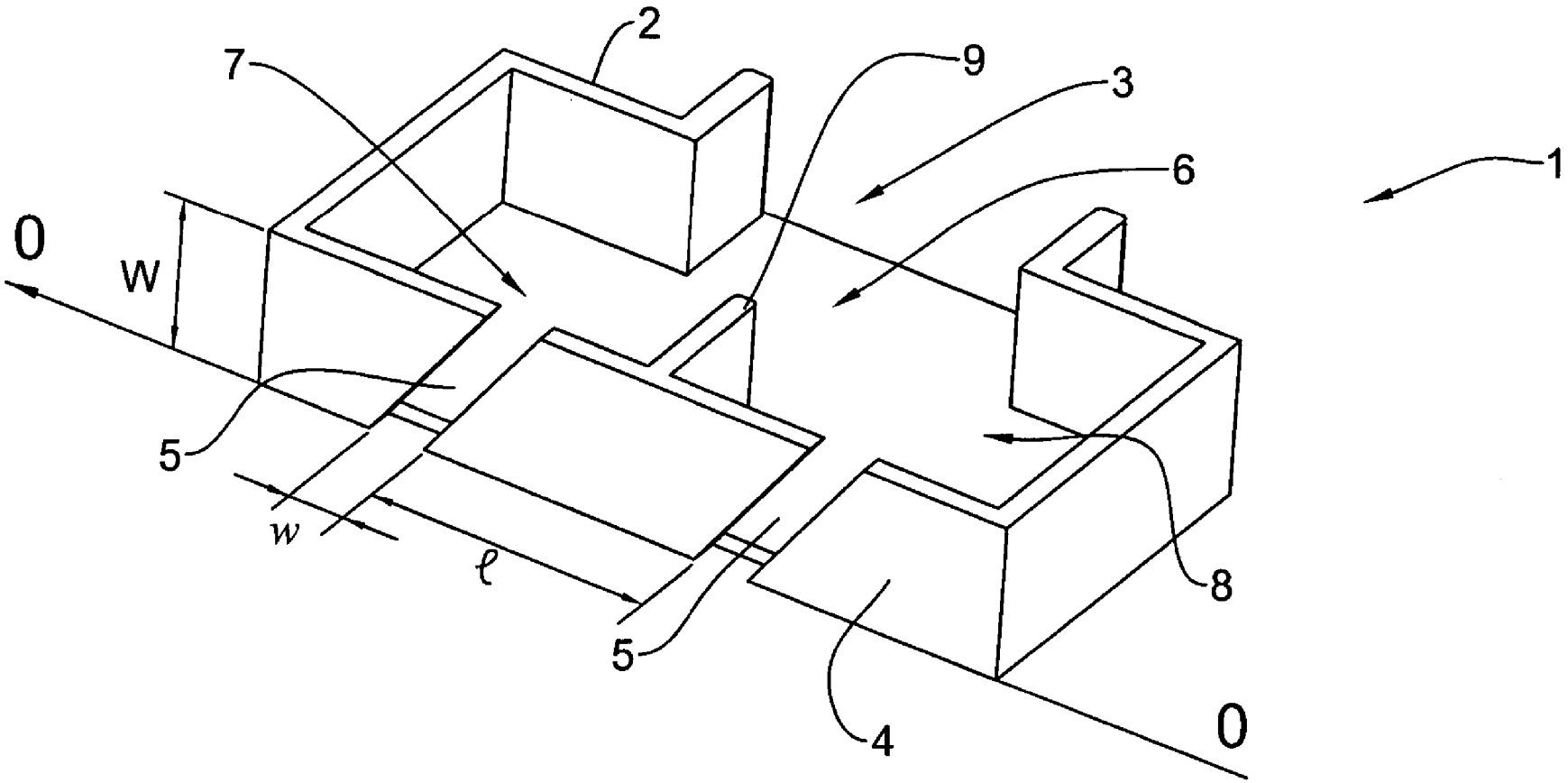
FIG. 1 is a perspective view of a basic waveguide slot antenna element of a slot antenna array, in accordance with an embodiment of the present invention.

Referring now to the drawings wherein like reference numerals designate corresponding parts throughout the several views, FIG. 1 illustrate a perspective view of a basic waveguide slot antenna element 1, in accordance with an embodiment of the present invention. The slot antenna element 1 is shown without an upper cover, for purposes of clarity. It should be understood that the basic slot antenna element 1 is not bound to the scale and proportion illustrated in FIG. 1. As will be shown hereinbelow, the basic slot antenna element 1 can be used for building various slot antenna arrays.

Preferably, the basic slot antenna element 1 is constructed of a unitary block made of an electrically conducted material, e.g., aluminum or other suitable material. The slot antenna element 1 has a non-radiating side 2, including a feeding port 3, and a radiating side 4 disposed opposite to the non-radiating side 2, which includes a pair of radiating slots 5. The basic slot antenna element 1 includes an electromagnetic energy splitter arrangement 6 in the form of an energy splitter accommodated between the radiating and non-radiating sides along a path of an ingress electromagnetic field propagating from the feeding port 3 towards the radiating slots 5.

The electromagnetic energy splitter 6 defines two chambers 7 and 8 separated by a partition wall 9. Each of the chambers 7 and 8 is coupled to the corresponding radiating slot 5.

In transmission mode, the basic antenna element 1 is fed with electromagnetic field through the feeding port 3. The ingress electromagnetic field is divided by the partition wall 6 of the energy splitter 6 into two halves, and passes into chambers 7 and 8, where the electromagnetic field is fed equally to the pair of radiating slots 5 to radiate an in-phase linear polarization perpendicularly to the longitudinal axis of the slots 5.

It should be understood by a person versed in the art that the waveguide slot antenna element 1 can be also utilized for reception of the electromagnetic field, mutatis mutandis, to operate in reception mode.

According to an embodiment of the invention, radiating slots 5 are spaced apart at a predetermined distance l. For example, the predetermined distance l can be in the range of 0.5 $\lambda$ to 0.9$\lambda$, and preferably about 0.7$\lambda$, where $\lambda$ is the desired operating wavelength of the antenna. Moreover, the radiating slots 5 are parallel to each other and slanted to a longitudinal axis O of the slot antenna element 1 in the same direction. For example, the slots 5 can be inclined at an angle in the range of 30° to 60°, and preferably at an angle of about 45° with respect to the longitudinal axis.

According to one non-limiting example, the dimensions for the basic slot antenna element 1 for the antenna operating in the frequency band X (8 GHz-10 GHz) can be set to the following values. The width W of the waveguide element 1 is 6.5 mm; the width w of each slot 5 is 1.6 mm; the slots 5 is inclined at 45°; the distance between the non-radiating side 2 and the radiating side 4 is 16 mm.

Figure 2:
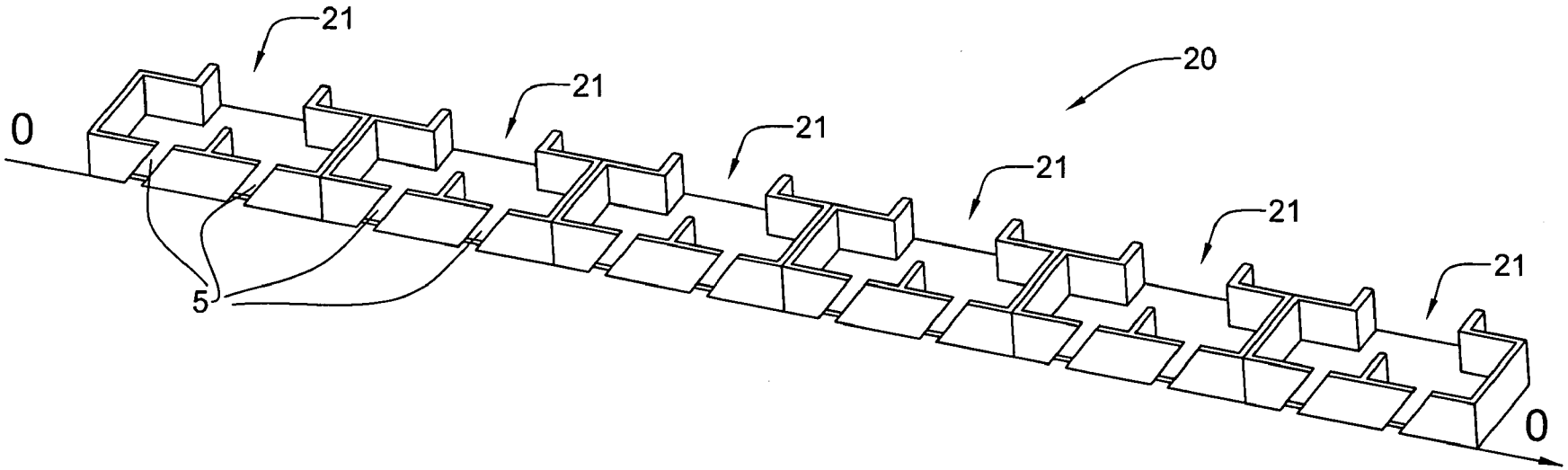
FIG. 2 is a perspective view of a slot antenna linear array, in accordance with an embodiment of the present invention.

The described construction of the waveguide element 1 can be utilized in a waveguide slot antenna arrays. Referring to FIG. 2, a perspective view of slot antenna linear array 20 is illustrated, in accordance with an embodiment of the present invention. The slot antenna linear array 20 includes a plurality of the basic slot antenna element 1 arranged along the longitudinal axis O in a side-by-side relation. Energy can be delivered to the feeding ports 21 through a common waveguide (not shown).

By this configuration, the slot antenna linear array 20 can operate as an antenna that generates a linear polarization electromagnetic field perpendicular to the longitudinal axis of the slot. It should be understood that although six adjacent slot antenna elements 1 in a row are shown in FIG. 2, in practice, any required number of the basic slot antenna elements can be employed.

Figure 3:
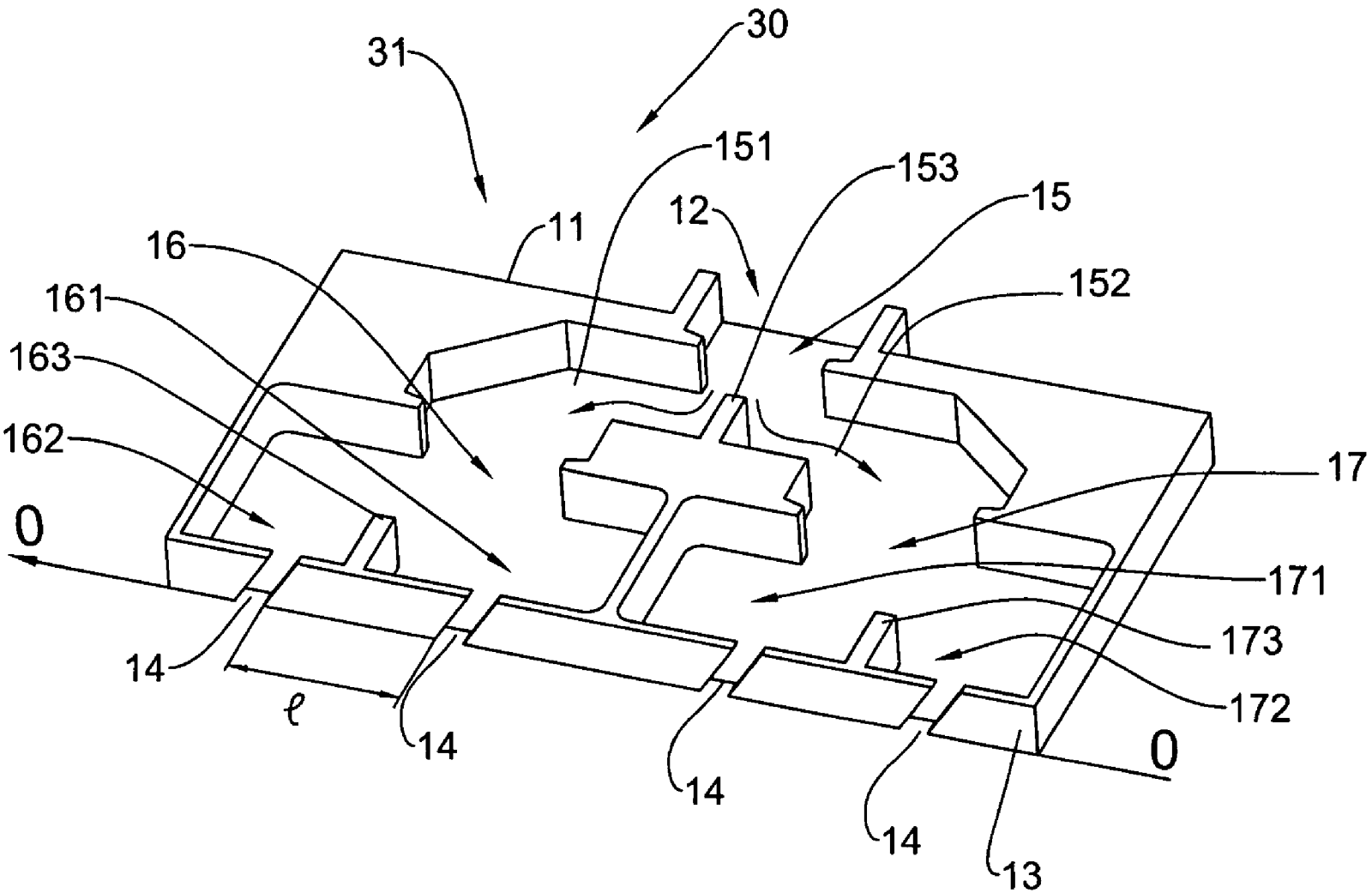
FIG. 3 is a perspective view of a waveguide slot antenna element, in accordance with another embodiment of the present invention.

Referring to FIG. 3 a perspective view of a waveguide slot antenna element 30 is illustrated, in accordance with another embodiment of the present invention. The slot antenna element 30 has a non-radiating side 11, including a feeding port 12, and a radiating side 13 disposed opposite to the non-radiating side 11, which includes radiating slots 14. According to the embodiment shown in FIG. 3, the slot antenna element 30 includes an energy splitter arrangement (energy divider) 31 accommodated between the radiating and non-radiating sides along a path of an ingress electromagnetic field propagating from the feeding port 12 towards the radiating slots 14.

The energy splitter arrangement 31 is configured as a two-stage energy splitter to direct the ingress electromagnetic field from the feeding port to the plurality of radiating slots. The energy splitter arrangement 31 includes a primary splitter 15 arranged downstream of the feeding port 12. The primary splitter 15 defines two chambers 151 and 152 separated by a partition wall 153. The chambers 151 and 152 are coupled to secondary splitters 16 and 17, respectively. The secondary splitter 16 defines two chambers 161 and 162 separated by a partition wall 163, while the secondary splitter 17 defines two chambers 171 and 172 separated by a partition wall 173, respectively. The four chambers 161, 162, 171 and 172 are coupled to the four radiating slots 14, correspondingly.

In transmission mode, the slot antenna element 30 is fed with electromagnetic field through the feeding port 12. The ingress electromagnetic field is divided by the partition wall 153 of the primary splitter 15 into two halves, and passes into chambers 151 and 152. Further, the electromagnetic field passes to the secondary splitters 16 and 17, where the field is secondary divided by the walls 163 and 173. Then, the field passes in the chambers 161, 162, 171 and 172, respectively, where the field is fed equally to the four radiating slots 14 to radiate an in-phase linear polarization perpendicularly to the longitudinal axis of the slots.

It should be understood by a person versed in the art that the antenna slot antenna element 30 can be also utilized for reception of the electromagnetic field, mutatis mutandis, to operate in reception mode.

It should be understood by a person versed in the art that generally, the waveguide slot antenna element is not bound by employing the two-stage divider 100, and in practice the slot antenna element can include an energy waveguide divider (not shown) that is configured as a multi-stage energy splitter to direct the ingress electromagnetic field divided by any required number of energy splitters from a feeding port to the corresponding number of radiating slots.

Figure 4:
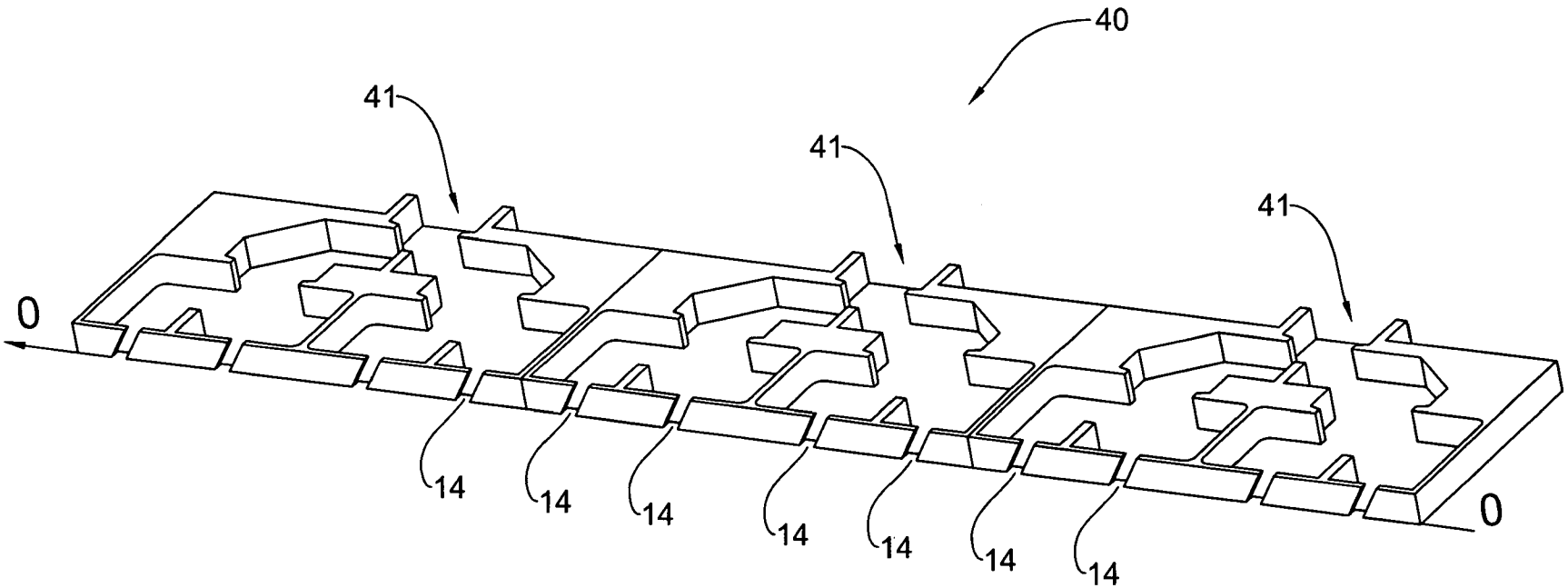
FIG. 4 is a slot antenna linear array, in accordance with another embodiment of the present invention.

Referring to FIG. 4, a slot antenna linear array 40 is illustrated, in accordance with another embodiment of the present invention. The slot antenna array 40 includes a plurality of the waveguide slot antenna elements 30 arranged along the longitudinal axis O in a side-by-side relation. Energy can be delivered to the feeding ports 41 through a common waveguide (not shown).

Similar to the configuration shown above in FIG. 2, the slot antenna array 40 can operate as an antenna that generates a linear polarization electromagnetic field perpendicular to the longitudinal axis of the slots 14. It should be understood that although three adjacent slot antenna elements 30 in a row are shown in FIG. 4, in practice, any required number of the slot antenna elements can be employed.

Figure 5:
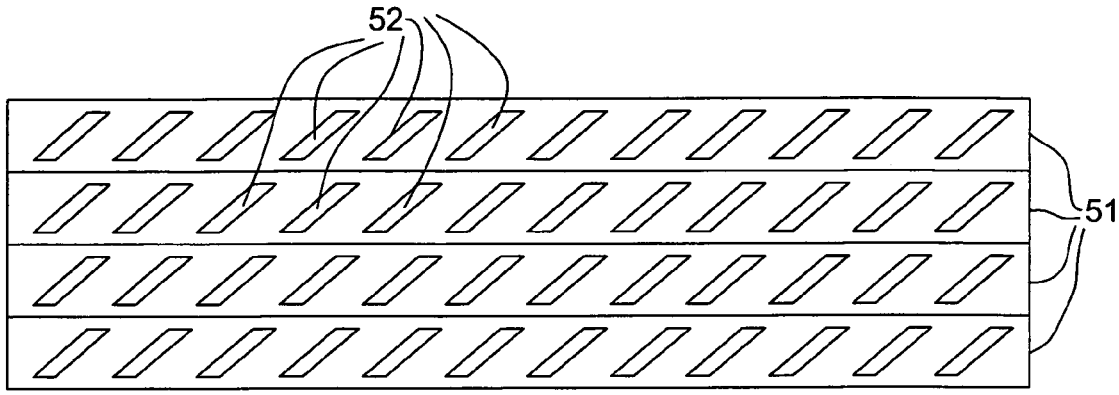
FIG. 5 is a schematic plan view of a waveguide slot antenna planar array, in accordance with an embodiment of the present invention.

Referring to FIG. 5, a schematic plan view of a waveguide slot antenna planar array 50 is illustrated, in accordance with an embodiment of the present invention. The slot antenna planar array 50 includes a plurality of slot antenna linear arrays 51 stacked in parallel relation. Examples of the slot antenna linear arrays 51 include, but are not limited to, the slot antenna linear array 20 shown in FIG. 2, the slot antenna linear array 40 shown in FIG. 4, and their combination.

When slot antenna planar array 50 is fed with electromagnetic field through the feeding ports (not shown). The ingress electromagnetic field is divided by the corresponding splitters (not shown) and fed equally to the corresponding radiating slots 52 to radiate an in-phase linear polarization perpendicularly to the longitudinal axis of the slots.

Figure 6:
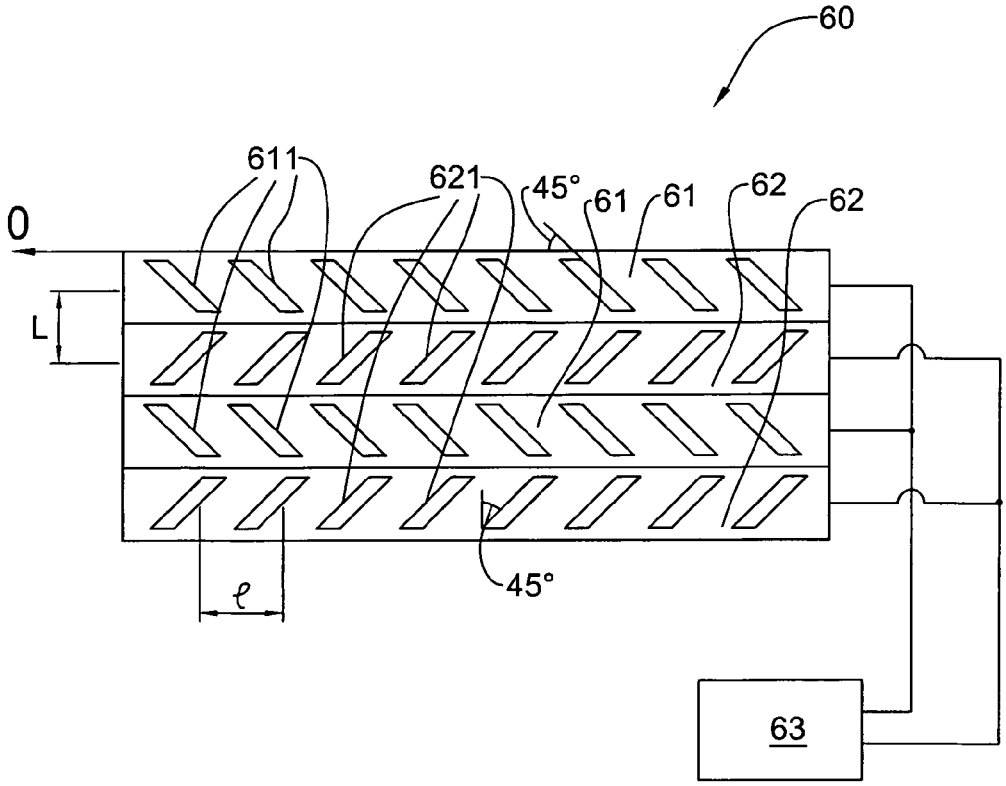
FIG. 6 is a schematic plan view of a waveguide slot antenna planar array, in accordance with another embodiment of the present invention.

Referring to FIG. 6, a schematic plan view of a waveguide slot antenna planar array 60 is illustrated, in accordance with another embodiment of the present invention. It should be noted that the blocks in FIG. 6 are intended as functional entities only, such that the functional relationships between the entities are shown, rather than any physical connections and/or physical relationships.

The slot antenna planar array 60 includes a first pair of slot antenna linear arrays 61 and a second pair of slot antenna linear arrays 62 arranged in parallel relation. Slots 611 of the first pair of slot antenna linear arrays 61 are interleaved with slots 621 of the second pair of slot antenna linear arrays 62 so that the slots 611 and 621 are slant to the longitudinal axis O in the counter directions. For example, the slots 611 and 621 can be slanted 45 degrees with respect to the longitudinal axis O of the slot antenna planar array 60, and be at right angles with respect to each other; although other slant angles could be used. According to the embodiment shown in FIG. 6, the slots in each pair of waveguide arrays are level with each other.

According to the embodiment of the invention, the radiating slots of the first pair of the slot antenna linear arrays can be shifted along the longitudinal axis at a certain distance with respect to the radiating slots of the second pair of the linear arrays.

In practice, the arrangement of the slot antenna planar array 60 enables to control the polarization of the radiated electromagnetic field of a predetermined frequency. The feeding ports (not shown) of the slot antenna linear arrays 61 and 62 can be supplied with energy independently of each other, and a field of desired polarization can be generated. For example, when the first pair of the linear arrays 61 is energized in phase with the second pair of linear arrays 62, the polarization of the radiated electromagnetic field is linear and perpendicular to the longitudinal axis O of the slot antenna planar array 60. In turn, when the energization of the slot antenna linear arrays 61 and 62 is out of phase (e.g., the phase is 180°), orthogonal linear polarization is generated; and when the energization of the linear arrays 61 and 62 is in phase quadrature (e.g., the phase is 90°, circular polarization is generated. In this respect, a phase-shift network shown by a block indicated by a reference numeral 63 can be utilized for varying the polarization dynamically. The operation of such a phase-shift network is known per se, thus it will not be expounded hereinbelow.

According to another embodiment of the invention, the first pair of slot antenna linear arrays 61 can be configured for operation with a linear polarization electromagnetic field having a first predetermined frequency. In turn, the second pair of slot antenna linear arrays 62 can be configured for operation with a linear polarization electromagnetic field having a second predetermined frequency. Thus, the interleaved arrangement shown FIG. 6 provides a compact dual linear polarization antenna. Such an antenna array can, for example, be utilized for communication purposes, where two different frequencies are used for transmitting and receiving modes.

It should be understood that the slot antenna planar arrays shown in FIGS. 5 and 6 can be configured such so as to provide a phased array antenna. In such a case, in order to avoid appearance of grating lobes in the radiation pattern of the phased array antenna formed of the slot antenna planar arrays of the present invention, the width W of the waveguide elements 1, 20, 30 and 40 should not exceed a predetermined value, to wit: $W \leqq 0.4\lambda$. This predetermined value is defined by the condition that the distance L between the linear arrays in the first and second pairs of slot antenna linear arrays 61 and 62 should be less or equal to $0.8\lambda$.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

It is apparent that the antenna of the present invention is not bound to the examples of the transmitting antennas. When necessary, the waveguide slot antenna array of the present invention can operate in receiving mode, mutatis mutandis.

It should be noted that although a one stage and two-stage energy splitter configurations are described above in detail with reference to FIG. 1 and FIG. 3, correspondingly, in practice, a multi-stage energy divider providing any required number of the splitting stages can be utilized.

It can be appreciated by a person of the art that the waveguide slot antenna array of the present invention may have numerous applications. The list of applications includes, but is not limited to, various communication, ranging and detection (radar) devices operating in the frequency range of about 300 MHz to 40 GHz.

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims.

The invention claimed is:

1. A waveguide slot antenna element comprising:

a non-radiating side including a feeding port;

a radiating side disposed opposite to the non-radiating side and including at least one pair of radiating slots spaced apart at a predetermined distance from each other, wherein said predetermined distance is in the range of $0.5\lambda$ to $0.9\lambda$, where $\lambda$ is the desired operating wavelength of the antenna; wherein the radiating slots are parallel to each other and slanted to a longitudinal axis of the waveguide antenna element in the same direction; and an energy splitter arrangement accommodated between said radiating and non-radiating sides along a path of an ingress electromagnetic field propagating from the feeding port towards said at least one pair of radiating slots.

2. The waveguide slot antenna element of claim 1 wherein said energy splitter arrangement is configured as a multi-stage energy splitter to direct the ingress electromagnetic field from the feeding port to the plurality of radiating slots.

3. The waveguide slot antenna element of claim 1 wherein said energy splitter arrangement comprises a primary splitter downstream of the feeding port, said primary splitter defining two primary chambers separated by a partition wall; each of the two primary chambers being coupled to a corresponding secondary splitter; each of the secondary splitters defining two secondary chambers separated by a corresponding partition wall; where each of the secondary chambers is coupled to one slot of the corresponding pair of radiating slots.

4. The waveguide slot antenna element of claim 1 wherein said predetermined distance is about $0.7\lambda$.

5. The waveguide slot antenna element of claim 1 wherein a tilt angle of the radiating slots with respect to the longitudinal axis is in the range of about 30° to 60°.

6. The waveguide slot antenna element of claim 1 having a waveguide width less than or equal to $0.4\lambda$.

7. The waveguide slot antenna element of claim 1 configured to operate within the frequency range of about 300 MHz to about 40 GHz.

8. A waveguide slot antenna linear array comprising a plurality of the waveguide slot antenna elements of claim 1 arranged along a longitudinal axis of said slot antenna linear array in a side-by-side relation.

9. A waveguide slot antenna planar array comprising a plurality of the waveguide slot antenna linear arrays of claim 8 arranged along a longitudinal axis of said waveguide slot antenna planar array and stacked in a parallel relation.

10. The waveguide slot antenna planar array of claim 9, wherein said plurality of the waveguide slot antenna linear arrays includes a first pair of slot antenna linear arrays and a second pair of slot antenna linear arrays arranged in a parallel relation, wherein the radiating slots of the first pair of slot antenna linear arrays are interleaved with the slots of the second pair of slot antenna linear arrays so that the slots of said first pair and the slots of said second pair are slant to said longitudinal axis in the counter directions.

11. A waveguide slot antenna planar array of claim 10 wherein the radiating slots of said first pair are slanted at about 45 degrees with respect to the longitudinal axis of the slot antenna planar array, and are at right angles with respect to the radiating slots of said second pair.

12. A waveguide slot antenna planar array of claim 10 wherein the radiating slots in each pair of slot antenna linear arrays are level with each other.

13. A waveguide slot antenna planar array of claim 10 wherein the radiating slots of the first pair of slot antenna linear arrays can be shifted along the longitudinal axis at a certain distance with respect to the radiating slots of the second pair of slot antenna linear arrays.

14. A method of operating the waveguide slot antenna planar array of claim 10, comprising:

supplying electromagnetic energy of a predetermined frequency to the feeding ports of said first pair of slot antenna linear arrays and said second pair of slot antenna linear arrays independently of each other; thereby to generate an electromagnetic field of desired polarization.

15. The method of claim 14 wherein said supplying of electromagnetic energy includes energizing the first pair of slot antenna linear arrays in phase with the second pair of slot antenna linear arrays, thereby to generate an electromagnetic field having the polarization of the radiated electromagnetic field linear and perpendicular to the longitudinal axis of the waveguide array antenna.

16. The method of claim 14 wherein said supplying of electromagnetic energy includes energizing the first pair of slot antenna linear arrays in out of phase with the second pair of slot antenna linear arrays, thereby to generate an electromagnetic field having orthogonal linear polarization of the radiated electromagnetic field.

17. The method of claim 14 wherein said supplying of electromagnetic energy includes energizing the first pair of slot antenna linear arrays and the second pair of slot antenna linear arrays in phase quadrature, thereby to generate an electromagnetic field having circular polarization.

18. The waveguide slot antenna planar array of claim 10, wherein distances between the linear arrays in the first and second pairs of slot antenna linear arrays are less or equal to $0.8\lambda$.

* * * * *